United States Patent [19]

Elder

[11] 4,029,079

[45] June 14, 1977

[54] LANTERN STOVE DEVICE ATTACHMENT

[76] Inventor: Joseph F. Elder, 1040 Bristol Circle, Garland, Tex. 75041

[22] Filed: Oct. 15, 1975

[21] Appl. No.: 622,683

[52] U.S. Cl. ..... 126/258; 126/47

[51] Int. Cl.[2] ..... F24C 5/04

[58] Field of Search ..... 126/4, 47, 48, 215, 126/258

[56] References Cited

UNITED STATES PATENTS

| | | | |
|---|---|---|---|
| 1,177,945 | 4/1916 | Gambel | 126/47 |
| 3,133,536 | 5/1964 | Knapp | 126/258 |
| 3,408,998 | 11/1968 | Brancato | 126/47 X |
| 3,804,075 | 4/1974 | Rummel | 126/258 |

*Primary Examiner*—Robert G. Nilson
*Attorney, Agent, or Firm*—Arthur M. Sloan

[57] ABSTRACT

A stove device attachment for a conventional lantern having a fuel reservoir, a glass globe enclosing a mantle which is illuminated by fuel from the reservoir, and a central connection for a draft hood. The attachment is connected to the top of the lantern by removing the ferrule or nut from the central connection for the draft hood positioning the attachment over the draft hood so that the central connection extends through a hole in the top plate or stove surface of the attachment, and replacing the ferrule or nut on the central connection. The attachment comprises three elements, a shield, a stove surface, and a skirt. The skirt is a tubular metal member which fits over the draft hood. The stove surface or grate fits over the skirt and the bottom surface of the grate is secured within the top of the skirt. The shield is secured to the back of the grate.

6 Claims, 3 Drawing Figures

LANTERN STOVE DEVICE ATTACHMENT

This invention relates to an improved stove device attachment for a conventional lantern having a fuel reservoir, a glass globe enclosing a mantle or mantles which are illuminated by fuel from the reservoir, and a central connection for a draft hood. The improved attachment of the subject invention is connected to the top of the lantern by removing the ferrule or nut from the top of the central connection for the draft hood, positioning the attachment over the draft hood so that the central connection extends through a hole in the top plate or stove surface of the attachment, and replacing the ferrule or nut on the central connection.

The attachment of the subject invention comprises thraee elements, namely, a shield, a stove surface or grate, and a skirt or collar. The skirt is a tubular metal member which fits over the draft hood of the lantern. The stove surface or grate fits over the skirt and the bottom surface of the grate is secured by a pressure fit within the top of the skirt. The shield is secured to the back of the grate by a tension fit between posts extending at right angles from the top and bottom of the back of the grate.

The improved attachment of the subject invention is simpler and more efficient than prior art devices. Contrary to prior art devices it does not require the removal of the draft hood of the lantern for installation but fits over the draft hood of the lantern. The attachment of the subject invention comprises only three elements, one of which, the shield may be detached and put aside when it is desired to accommodate large area utensils on the cooking or top surface of the grate.

The primary object of the subject invention is to provide an improved attachment for a lantern which facilitates utilization of the heat produced by the lantern for cooking without interfering with utilization of the light giving power of the lantern.

Another object of the invention is to provide an improved means for supporting cooking utensils or other articles to be heated by the heat generated in a lantern.

Still another object of the subject invention is to provide an improved attachment capable of being used with different types of lanterns.

Another object of the subject invention is to provide an improved attachment having a stove surface or grate including structure effecting maximum heat utilization and efficiency.

Yet another object of the subject invention is to provide an improved attachment that is easy to install, to assemble, and disassemble, and store and which when installed on a lantern does not interfere with its use as a lantern.

A further object of the subject invention is to provide a device of the character mentioned above which is simple, relatively inexpensive and practicable to manufacture, safe, and conveniently and easily used, and which will give generally efficient and durable service.

Additional objects of the subject invention will be evident from the following detailed description and drawings wherein for purposes of illustration, an embodiment of my invention is shown.

Figure 1:
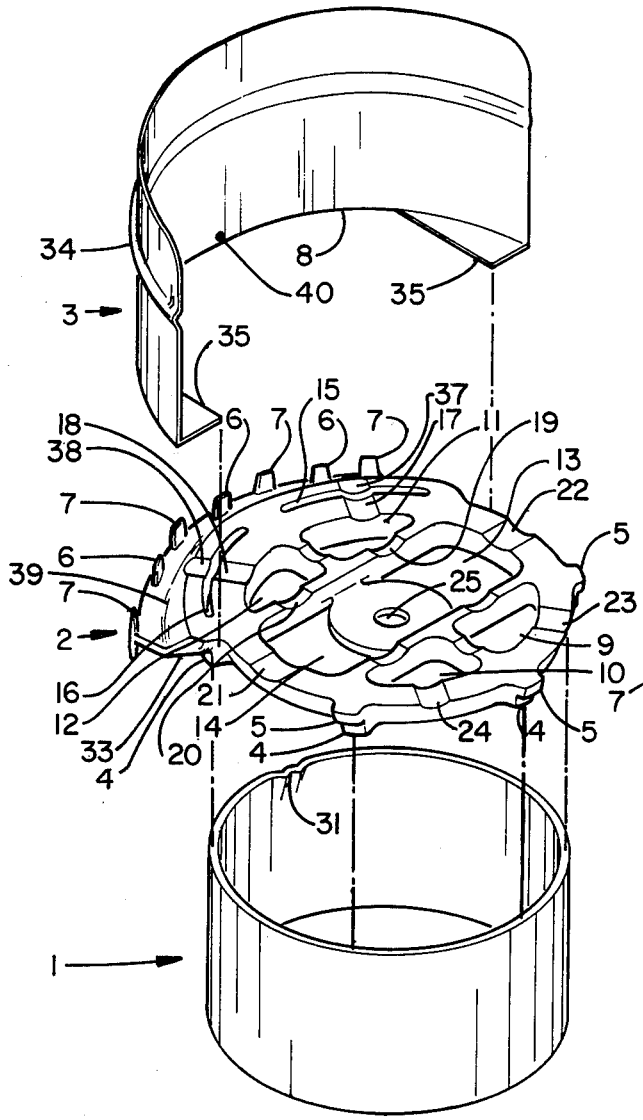
FIG. 1 is an exploded view of an embodiment of the attachment of the subject invention.
Figure 2:
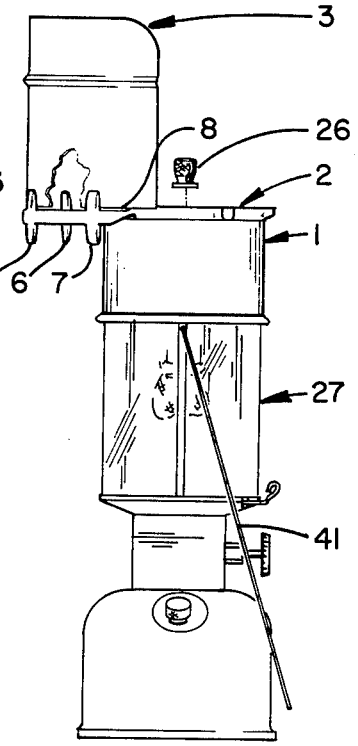
FIG. 2 is a side view of an embodiment of the subject invention installed on a typical lantern.

A number of different types of lanterns of the portable combustion type are on the market. In addition to giving off substantial light, these lanterns give off considerable heat which is normally dissipated through a flue resulting in a waste of energy. The subject invention effects maximum efficient utilization of energy while providing hunters, fisherman, campers and others with a simple and effective means of cooking food and heating beverages without interference with utilization of their light source Turning to the drawings in FIGS. 1 and 2, skirt or collar 1 is shown fitting over the draft hood of a typical lantern 27 in FIG. 2.

The top plate or grate 2 presents a stove surface to support cooking utensils or other objects to be heated. The top plate or grate 2 fits over the skirt 1 and is supported on the top edge of the skirt 1 by projections or flanges 5 and the surface 33. The grate is removeably secured to the skirt 1 by a pressure or tension fit of the surfaces 4 against the inner surface of the top of the skirt 1 and the crimp or corrugation 31.

The shield 3 which may be provided with stiffening bead 34 to keep the shield in proper shape is removeably secured to the grate 2 by pressing or pushing the surface 8 between the tiers of vertically upward-projecting posts or flanges 6 and 7 at the back of the grate 2.

When a cooking utensil with a surface area greater than the surface area of the grate 2 is utilized the shield 3 is removed. The shield 3 helps to keep the wind from dissipating the available heat and when the shield 3 should have its back facing the wind. The shield 3 may be provided with tabs or flanges 35 to further decrease heat dissipation from the wind.

The shield 3 may be inverted and attached between the tiers of vertically downward projecting posts or flanges 6 and 7 and when so installed the heat shield 3 acts as a light shield and is also conveniently stored.

The openings 9, 10, 11, 12, 13, and 14 are for purposes of ventilation and to allow proper circulation and venting for maximum efficiency of heat utilization. Openings or slots 15 and 16 enable heat to exhaust at a slower rate which results in heat build up which makes the heat flow forward under the cooking utensil. Slots or indentations 17, 18, 19, 20, 21, 22, 23, and 24 are channels which keep the heat circulating uniformly and cause the heat to evenly exhaust between the grate 2 and the skirt 1.

The hole 25 fits over the central connection of the lamp 27 and the grate 2 is secured to the threaded end of the central connection by ferrule or knurled nut 26.

Figure 3:
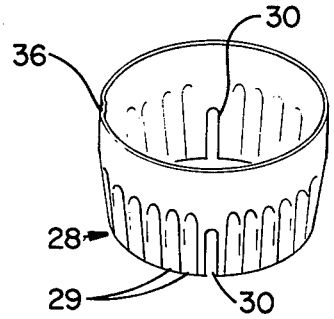
FIG. 3 is a perspective view of an alternate form of skirt or collar of the attachment of the subject invention.

An alternate form of skirt 28 is shown in FIG. 3 for use with one mantle lanterns. Note crimps 29 at the bottom of the skirt 28 to reduce size to fit one mantle lanterns. Also note slots 30 opposite each other to receive a lantern bail or handle such as handle 41 and crimp 36 to abut against surfaces 4 to effect a pressure fit of the grate 2.

When the shield 3 is in top position, the handle or bail such as the bail 41 of the lantern 27 may still be used in half-position. With the shield 3 removed the bail or handle may be used in all positions.

The grate 2 may be of heavy cast aluminum which stores heat and transfers the heat to the utensil to be heated.

Indented slots 37 and 38 allow heat to move under the cooking utensil and up between the shield 3 and the cooking utensil which makes the utensil heat more rapidly.

The center hole 25 is recessed so that the top of the knurled nut 26 when securing the grate 2 is flush with or lower than the top surface of the grate 2. The under surface of the hole 26 may be tapered or grooved to prevent the undersurface of the hole 26 from adhering to the draft hood of the lantern when the metals expand on heating.

The rear or back 39 of the grate 2 is recessed and serves as a wind break to keep from being blown forward and to make the tops of the posts 6 and 7 level with the top of the grate to properly balance and support larger utensils put on the grate with the shield 3 removed.

Dot 40 may be provided for purposes of aligning the shield 3 when assembling it to the top of the grate 2.

What I claim as my invention and desire to secure by letters patent of the United States is:

1. A stove device attachment for lanterns including a skirt, a grate, and a shield in which the skirt is adapted to fit over and around the draft hood of a conventional lantern of the combustion-type, the grate is adapted to removeably pressure fit within and be supported on the top of the skirt and to be removeably secured to the lantern by means of the lantern central connection and the draft hood connection nut of the lantern, and the shield is adapted to removeably pressure fit within structure on the back of the grate, in which the means for pressure fitting the grate within the top of the skirt includes crimping in the top of the skirt and recessed surfaces on the bottom of the grate to form a pressure interface with the crimped surface and other portions of the inner circumference of the top of the skirt, the means for supporting the grate on top of the skirt includes projections above the recessed surfaces and around the back of the grate, the means for securing the grate to the lantern includes structure defining a hole in the grate so that the hole in the grate is adapted to fit over the central connection of a conventional lantern, and the structural means for pressure fitting the shield on the back of the grate includes staggered tiers of prongs extending at right angles above and below the surface of the back of the grate.

2. A stove device attachment for lanterns as described in claim 1 in which the shield includes a horizontal bead to add structural strength to the shield and perpedicular inwardly extending tabs at each end of bottom of the shield to maximize retention of heat radiated by the lantern within the grate area.

3. A stove device attachment for lanterns as described in claim 2 in which the back of the grate is recessed so that the tops of the upwardly extending tiers of prongs are flush with the primary grate surface, in which the structure defining a hole in the grate is recessed so that when a lantern draft hood connection nut secures the grate to the lantern such nut does not extend above the primary grate surface, and in which the underside of the structure defining a hole in the grate is tapered to prevent adhesion of the grate to the draft hood when the connection nut is tightened and the grate is heated.

4. A stove device attachment for lanterns as described in claim 3 including structure defining openings and indentations in the grate arranged symmetrically around the structure defining a hole in the grate to keep heat circulating at a uniform flow and exhausting evenly between the grate and the skirt.

5. A stove device attachment for lanterns as described in claim 4 including structure defining two elongated slots in the rear of the grate to enable heat to move forward and under a cooking utensil when it is placed on the grate and structure defining two indented slots behind the structure defining elongated slots to enable heat to move forward and under a cooking utensil when it is placed on the grate and up between the shield and the cooking utensil.

6. A stove device attachment for lanterns as described in claim 5 in which the skirt includes crimping all around its lower circumference to enable it to fit on different size lanterns and in which the skirt includes two slots in the lower circumference of the skirt disposed opposite each other to receive a lantern bail.

* * * * *